US008696059B2

(12) United States Patent
Carmichael, IV

(10) Patent No.: US 8,696,059 B2
(45) Date of Patent: Apr. 15, 2014

(54) SEAT CUSHION

(75) Inventor: Daniel L. Carmichael, IV, Duluth, GA (US)

(73) Assignee: Carmichael Throne Company, Suwanee, GA (US)

( * ) Notice: Subject to any disclaimer, the term of this patent is extended or adjusted under 35 U.S.C. 154(b) by 14 days.

(21) Appl. No.: 13/308,536

(22) Filed: Nov. 30, 2011

(65) Prior Publication Data

US 2013/0009441 A1 Jan. 10, 2013

Related U.S. Application Data

(63) Continuation-in-part of application No. 29/396,783, filed on Jul. 7, 2011, now Pat. No. Des. 672,584.

(51) Int. Cl.

| | |
|---|---|
| ***A47C 7/18*** | (2006.01) |
| ***B60N 2/38*** | (2006.01) |
| ***B60N 2/40*** | (2006.01) |
| ***B62J 1/00*** | (2006.01) |
| ***B62J 1/18*** | (2006.01) |
| ***B62J 1/26*** | (2006.01) |
| ***A47C 9/00*** | (2006.01) |
| ***A47C 9/08*** | (2006.01) |

(52) U.S. Cl.

USPC ..... 297/202; 297/195.11; 297/201; 297/312; 297/452.27; 297/461

(58) Field of Classification Search

USPC ..... 297/195.11, 201, 202, 312, 452.27, 461
See application file for complete search history.

(56) References Cited

U.S. PATENT DOCUMENTS

| | | | | |
|---|---|---|---|---|
| 2,492,671 | A * | 12/1949 | Wettlaufer | 601/49 |
| 4,132,228 | A | 1/1979 | Green | |
| 4,290,644 | A * | 9/1981 | Hu et al. | 297/195.1 X |
| D278,779 | S | 5/1985 | Sink | |
| 4,522,447 | A | 6/1985 | Snyder | |
| 4,571,763 | A | 2/1986 | Suzuyama | |
| 4,713,854 | A | 12/1987 | Graebe | |
| 4,824,174 | A | 4/1989 | Dunn, Sr. | |
| 5,024,485 | A * | 6/1991 | Berg et al. | 297/312 |
| 5,201,087 | A * | 4/1993 | Wickham et al. | 297/312 X |
| 5,395,162 | A | 3/1995 | Jay | |

(Continued)

FOREIGN PATENT DOCUMENTS

| | | |
|---|---|---|
| WO | WO8607528 | 12/1986 |
| WO | WO2004037945 | 5/2004 |
| WO | WO2006134191 | 12/2006 |

*Primary Examiner* — Rodney B White

(74) *Attorney, Agent, or Firm* — Jones IP Law, LLC; Dennis W. Jones

(57) ABSTRACT

A seat cushion for reducing back pain via elevating specific areas of a user's posterior and back is provided. The seat cushion includes two outer sections of generally semicircular shape and first height, each having a lower layer of firm foam of first thickness and an upper layer of soft foam of second thickness, the first thickness exceeds the second thickness, an inner section of generally rectangular shape with length and width and second height less than the first height, the inner section extends lengthwise between the outer sections forming a channel above the inner section and between the outer sections, a cushion base provides support for the underside of the outer sections and inner section, whereby for the user sitting on the seat cushion, a specific area of the user's posterior and back aligned with the channel is elevated above the channel to relieve pressure on the specific area.

16 Claims, 7 Drawing Sheets

(56) References Cited

U.S. PATENT DOCUMENTS

| | | | | |
|---|---|---|---|---|
| 5,580,128 | A | 12/1996 | Johnson | |
| 5,702,153 | A | 12/1997 | Pliska | |
| 5,722,729 | A * | 3/1998 | Carilli | 297/452.55 |
| 6,079,782 | A * | 6/2000 | Berg et al. | 297/312 X |
| 6,523,202 | B2 | 2/2003 | Loomos | |
| 6,672,660 | B2 | 1/2004 | Hoshino | |
| 6,820,938 | B2 | 11/2004 | Barrett | |
| 6,866,340 | B1 | 3/2005 | Robertshaw | |
| 6,880,885 | B2 | 4/2005 | Lan | |
| 6,893,090 | B1 * | 5/2005 | Van Deursen et al. | 297/312 |
| 7,024,712 | B2 * | 4/2006 | Fujita et al. | 297/202 X |
| 7,216,388 | B2 | 5/2007 | Bieganek | |
| 7,344,196 | B2 | 3/2008 | Rodriquez | |
| 7,416,253 | B2 | 8/2008 | Kim | |
| 7,802,853 | B2 | 9/2010 | Ebe | |
| 8,251,441 | B2 * | 8/2012 | Alink | 297/312 X |
| 2002/0175553 | A1 | 11/2002 | Steifensand | |
| 2006/0150338 | A1 | 7/2006 | Jackson, III | |
| 2006/0185093 | A1 | 8/2006 | Yu | |
| 2007/0252419 | A1 * | 11/2007 | Takahashi | 297/312 |
| 2008/0265641 | A1 | 10/2008 | Kim | |
| 2010/0078979 | A1 | 4/2010 | Nemoto | |
| 2010/0301646 | A1 | 12/2010 | Chang | |

* cited by examiner

SEAT CUSHION

CROSS-REFERENCE TO RELATED APPLICATIONS

This application is a continuation-in-part of prior application Ser. No. 29/396,783, filed Jul. 7, 2011.

BACKGROUND

1. Field of Invention

This invention pertains to reducing back pain. More particularly, this invention provides for reducing pressure to the spine and to other sensitive areas.

2. Description of the Related Art

Oftentimes people are required to perform their daily work while seated. Many leisure activities also involve prolonged periods of sitting. Long periods of sitting have increasingly been identified as a major cause of lower back pain. Studies have indicated that changes in the curvature of the spine that occur due to a person being seated for long periods of time are one cause of lower back pain. Other problems that have become associated with sitting for long periods of time include, pressure ulcers, decreased blood flow, and aggravation of pre-existing hemorrhoids.

When a person spends a long period of time seated on a chair, coccygodinia becomes increasingly likely to occur. Coccygodinia is a pain in the coccyx or tailbone at the end of the lumbar. Continued sitting with such pain becomes increasingly difficult. Also, a person with hemorrhoids has difficulty in maintaining posture for a long time while sitting.

Studies have also shown that lack of spinal motion creates stretch in spinal ligaments and hampers fluid flow into the disc which leads to insufficient nutrition of the vertrebral discs. The discs, ligaments, and muscles of the human back bear more stress while sitting than during standing or most other activities.

Additionally, researchers have observed spinal shrinking after prolonged sitting. An individual's height after a prolonged time in a sitting position is actually shorter than it was before the prolonged sitting period.

Other studies have demonstrated adverse effects on muscles with prolonged low-level static loading on the back due to prolonged sitting. Prolonged activity, even the low-level activity associated with sitting, leads to impaired oxygenation of muscle tissues and has been implicated as a cause of back pain.

Sitting, especially prolonged sitting is generally accepted as a risk factor in developing low back pain. Several factors are considered to be important components of this association, including disc compression, lack of spinal motion and loading of the spine stabilizing muscles.

Since prolonged sitting is unlikely to go away, it is apparent that there needs to be a mechanism for sitting that relieves back pain rather than making it worse.

BRIEF SUMMARY

According to one embodiment of the present invention, a seat cushion for use in reducing back pain is provided. The seat cushion provides a channel or trough, that is, an empty space, separating two foam type cushion sections and extending lengthwise from the front to the rear of the seat cushion to relieve pressure to the spine and to specific areas while the person is sitting upon the seat cushion in alignment with the channel. The seat cushion provides for reducing pressure to the spine by reducing compression in the vertebrae. The channel provides for support to the posterior of a sitting person, while also allowing the coccyx (tailbone) to remain afloat above the surface of the channel.

The seat cushion provides elevation of the spine and for reduced pressure to the spine by reducing compression of the vertebrae. The elevation provides for reduced pressure to specific areas such as the coccyx, lumbar region, anus, and prostrate, while sitting. The elevation of the posterior above the channel provides for a floating spine, whether the person is seated at the forward, middle, or rear of the seat or chair that contains the seat cushion. As such, use of the seat cushion provides relief from back pain, coccyx fracture, coccyx pain, hemorrhoids, inflamed prostrate, and anal pain. Use of the seat cushion also reduces constriction of the aorta and can improve blood circulation in the legs. Also, the seat cushion generally reduces fatigue that is often caused by sitting. Additionally, the seat cushion relieves the pressure on the anal region and provides for a comfortable seating experience.

Another embodiment provides for reducing back pain via elevation of specific areas of a user's posterior and back, the seat cushion including (1) two outer sections having a generally semicircular shape and a first height, each outer section including a lower layer of firm foam having a first thickness and an upper layer of soft foam having a second thickness, wherein the first thickness exceeds the second thickness, (2) an inner section having a generally rectangular shape with a length and a width and a second height, the second height less than the first height, the inner section extending lengthwise between the outer sections, wherein a channel is formed above the inner section and between the outer sections, the channel having a channel height and a channel width, and (3) a cushion base corresponding and providing support to the underside of the two outer sections and the inner section, whereby for the user sitting on the seat cushion, a specific area of the user's posterior and back aligned with the channel is elevated above the channel to relieve pressure on the specific area.

BRIEF DESCRIPTION OF THE DRAWINGS

The above-mentioned features will become more clearly understood from the following detailed description read together with the drawings in which.

DETAILED DESCRIPTION

A seat cushion for reducing back pain is disclosed. In particular, the seat cushion provides a channel separating two foam type cushion sections and extending lengthwise from the front to the rear of the seat cushion to relieve pressure to the spine and to specific areas while the person is sitting upon the seat cushion in alignment with the channel.

Sitting, especially prolonged sitting is generally accepted as a risk factor in developing low back pain. Several factors are considered to be important components of this association, including disc compression, lack of spinal motion and loading of the spine stabilizing muscles.

The seat cushion provides for reducing pressure to the spine by reducing compression in the vertebrae. The seat cushion includes a channel or trough, that is, an empty space, which runs lengthwise from the front to the rear of the seat cushion. Support is provided to the remainder of the posterior of a sitting person, while also allowing the coccyx (tailbone) to remain afloat above the surface of the channel.

The seat cushion provides for reduced pressure to the spine and other specific areas while sitting. The channel within the seat cushion provides for a floating spine, whether the person is seated at the forward, middle, or rear of the seat or chair that contains the seat cushion. The seat cushion provides relief from back pain, coccyx fracture, coccyx pain, hemorrhoids, inflamed prostrate, and anal pain. Additionally, use of the seat cushion also reduces constriction of the aorta and can improve blood circulation in the legs. Also, the seat cushion generally reduces fatigue that is often caused by sitting. Additionally, the seat cushion relieves the pressure on the anal region and provides for a comfortable seating experience.

Figure 1:
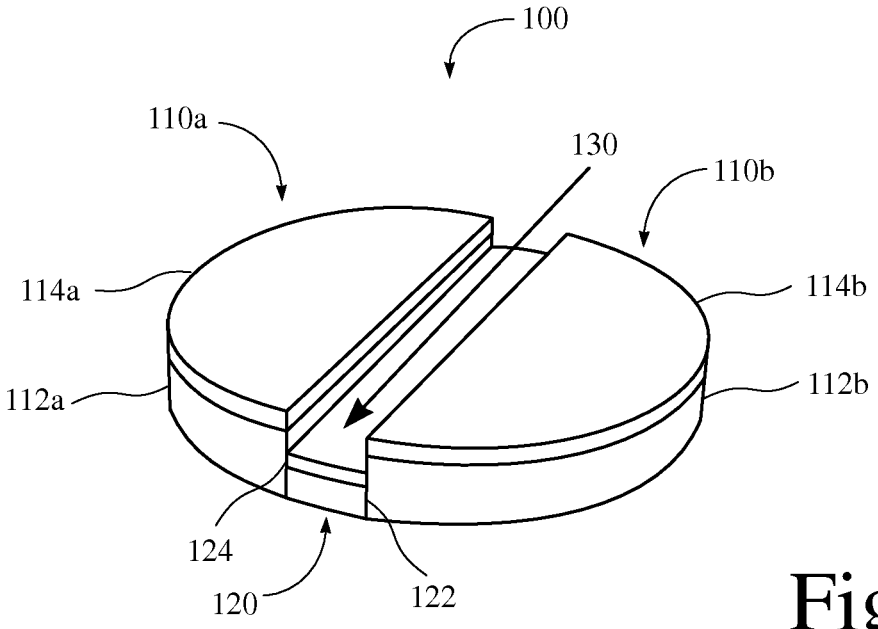
FIG. 1 is a perspective view of a seat cushion.
Figure 2:
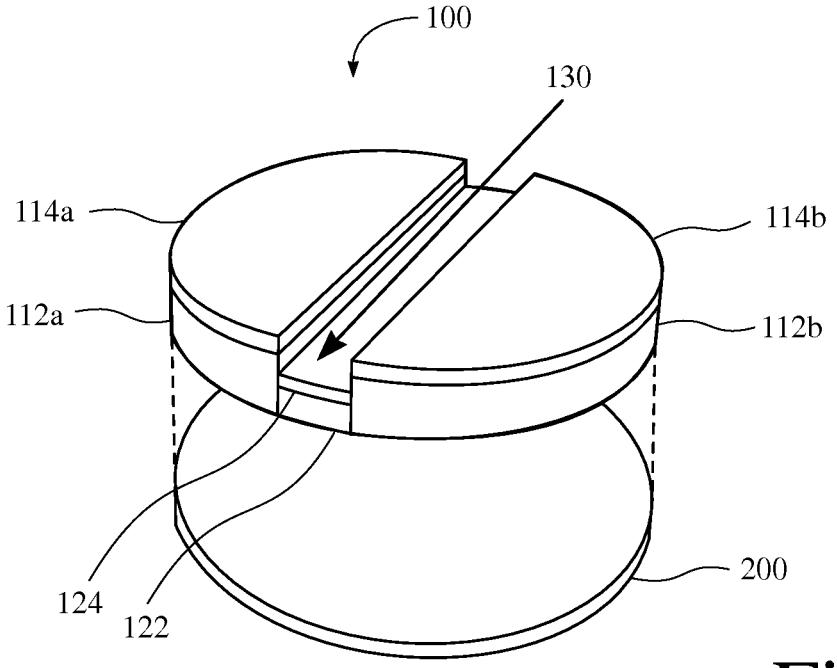
FIG. 2 is a partially exploded perspective view of the seat cushion of FIG. 1 with a base portion.

Turning now to the drawings, FIG. 1 is a perspective view of a seat cushion 100. In the illustrated embodiment, the seat cushion 100 is substantially round when viewed from the top and is adapted for a stool or other generally round base for seating. FIG. 2 is a partially exploded perspective view of the seat cushion 100 with such a base 200. The seat cushion 100 includes two substantially semi-circular edge sections 110 separated by a central section 120. Each edge section 110*a*, 110*b* includes a lower portion 112*a*, 112*b* and an upper portion 114*a*, 114*b* respectively. The central section 120 includes a central lower portion 122 and a central upper portion 124.

In one embodiment, the base 200 (or cushion base) is a wooden board of sufficient thickness and strength to provide support for the seat cushion 100 as well as an individual that is sitting on the seat cushion 100. The base 200 provides for securing the seat cushion 100 to a stool (see FIG. 11), to a chair (see FIG. 12), or the like. The base 200 also provides for using the seat cushion 100 as a portable seat cushion 100 that can be used in any place where a seat cushion 100 is needed. In one such embodiment, the base 200 is modified to fit the location where it is to be used. For example, use in an automobile can be achieved by modifying the base 200 to adapt to the existing seat or, in the alternative, the automobile seat can be removed and the base 200 adapted to fit in much the same was as a typical automobile seat. In similar fashion, the seat cushion 100 is adaptable for use in airplanes, buses, and the like.

Each edge section 110 fits adjacent the central section 120 on opposite sides and the central section 120 is of lower height than the edge sections 110. In one embodiment, the central section 120 is approximately one-half the height of the edge sections 110. The edge sections 110 and the central section 120 combine to form a channel 130 between the edge sections 110 and above the central section 120. The channel 130 extends the entirety of the length from front to back of the seat cushion 100.

Figure 3:
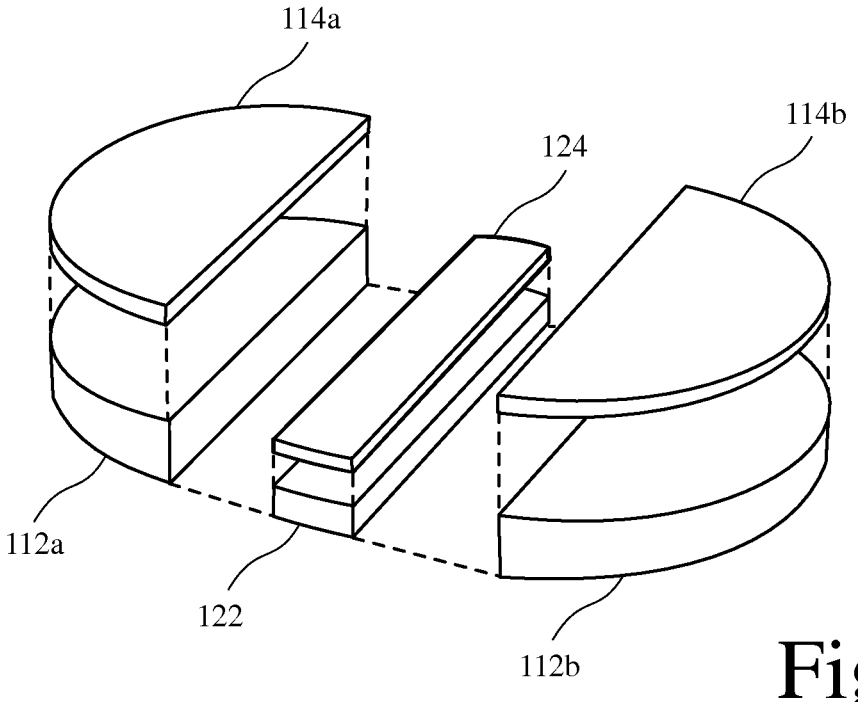
FIG. 3 is an exploded perspective view of the seat cushion of FIG. 1.
Figure 4:
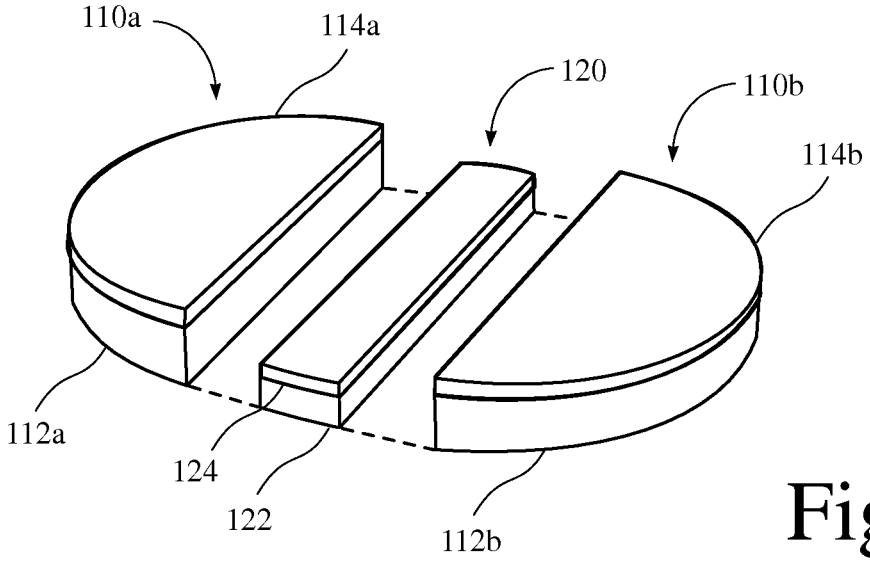
FIG. 4 is a partially exploded perspective view of the seat cushion of FIG. 1 illustrating the main sections.

FIG. 3 is an exploded perspective view of the seat cushion 100 and FIG. 4 is a partially exploded perspective view of the seat cushion 100 showing the edge sections 110 and a central section 120. In one embodiment, the lower portions 112*a*, 112*b* of the edge sections 110 are made from a firm foam, such as a polyurethane foam, for example. The lower portions 112 provide sufficient firmness so that the seat cushion 100 does not collapse the channel 130 when a person is seated on the seat cushion 100. That is, the channel 130 remains an open space when a person is seated on a seat or chair that is assembled from the seat cushion 100. Those of skill in the art will readily appreciate that other suitable materials may also be used for the lower portions 112, so long as the lower portions 112 provide sufficient firmness that the channel 130 is not collapsed when a person is sitting on the seat cushion 100.

In one embodiment, the upper portions 114*a*, 114*b* of the edge sections 110 are made from soft foam, such as polyurethane foam, for example. It will be readily appreciated by those of skill in the art that polyurethane foam provides varying levels of firmness according to desired use. The polyurethane foam used in the upper portions 114 include foam that is more flexible, that is, a softer foam, than does the polyurethane foam used for the lower portions 112. The upper portions 114 include foam that is more flexible and that provides a level of "give" when a person is seated on the seat cushion 100. Again, those of skill in the art will readily appreciate that other suitable materials may also be used for the upper portions 114, so long as the upper portions 114 in combination with the lower portions 112 do not collapse the channel 130 when the seat cushion 100 is in use. In one embodiment, the lower portion 112 has a height or thickness that is approximately three times that of the upper portion 114, that is the ratio of the height of the lower portion 112 to the upper portion 114 is 3:1.

The width of the channel 130 is sufficient to create an open space for elevation of a specific area, such as the coccyx or tailbone. In one embodiment, the ratio of the channel width to channel depth is 5:3. One typical embodiment of the seat cushion 100 includes a channel that is approximately 2½ inches wide and 1½ inches in depth.

Additionally, the channel depth adds visibility for the user to align themselves to the seat cushion 100. A person will sit with legs substantially parallel to the channel so that the central portion of the lower back, the coccyx or tailbone, straddles the channel. In this way, the spine is elevated above the channel while the body is supported by the legs or buttocks on the edge portions 110. This elevation reduces pressure to the spine, the lower back, and to sensitive areas affected by back pain or other localized pain.

The upper portions 114 are secured to the lower portions 112 via an adhesive of suitable strength so that the upper portion 114 is permanently affixed to the lower portion 112. When the upper portion 114 is affixed to the lower portion 112, an edge section 110 is formed. Similarly, the upper central section 124 is affixed to the lower central section 122 to form the central section 120. In one embodiment, each of the respective sections, that is the central section 120 and the two edge sections 110*a*, 110*b* are maintained separate so that each is wrapped with upholstery or any other type covering. Once the respective sections are covered they are secured to the base 200 to form the seat cushion 100.

In another embodiment, the flat side of each of two edge sections 110 are similarly affixed to each side or edge of the central section 120 via an adhesive of suitable strength so that each edge section 110 is permanently affixed to the central section 120. In one such embodiment, the sides of the lower sections 112*a*, 112*b* are affixed to either side of the central section 120. That is, each flat side of the lower sections 112*a*, 112*b* are affixed to opposite sides of the central section 120.

In one embodiment, each upper portion 114 is affixed to a lower portion 112, so that two edge sections 110 are formed, and the two edge sections 110 are affixed to each side of the central section 120 so that a seat cushion 100 as in FIG. 1 is formed. In another embodiment, the seat cushion 100 also includes a base 200 as in FIG. 5. In such an embodiment, a covering can be applied to the entire seat cushion 100 and secured to the bottom or underside of the base 200.

Figure 5:
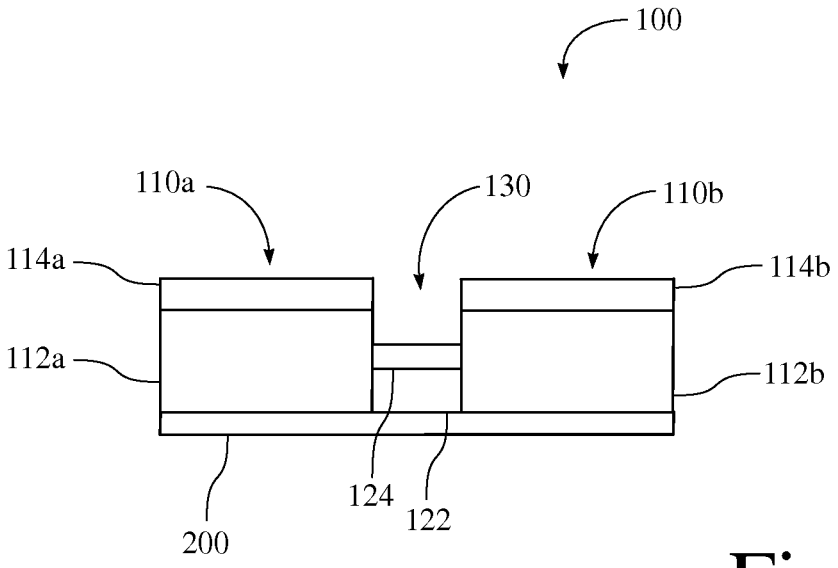
FIG. 5 is a side view of the seat cushion of FIG. 1.

FIG. 5 is a side view of the seat cushion 100. The seat cushion 100 includes a base 200, two edge sections 112*a*, 112*b*, two upper sections 114*a*, 114*b*, a lower central section 122, and an upper central section 124. As described above, the channel 130 extends through the seat cushion 100 in the space above the upper section 124.

Figure 6:
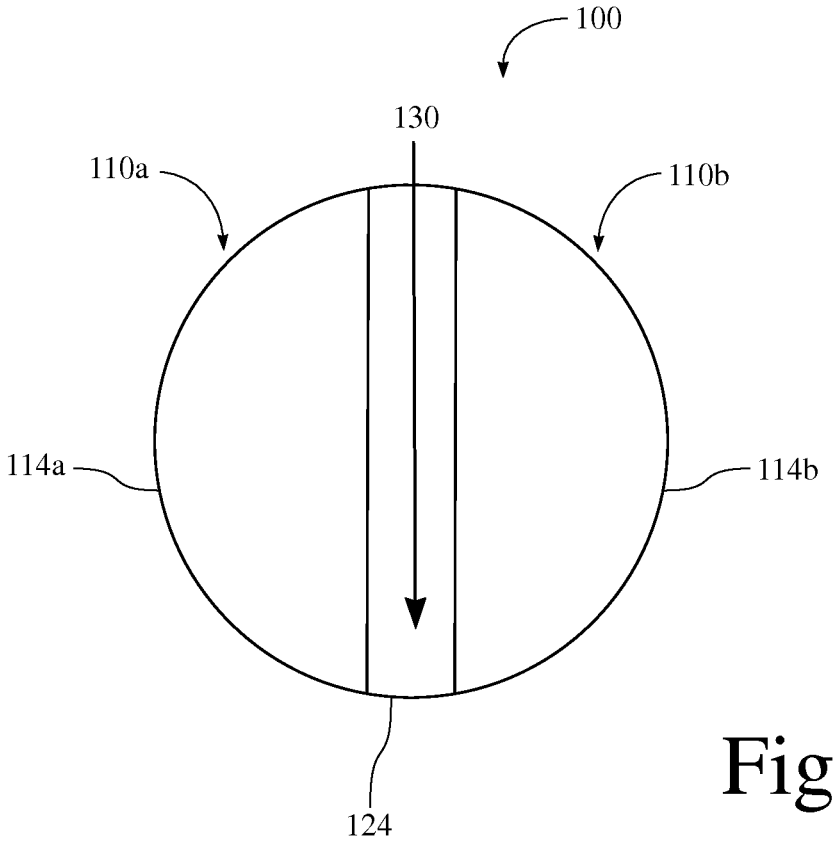
FIG. 6 is a top view of the seat cushion of FIG. 1.

FIG. 6 is a top view of the seat cushion 100. As described above, the upper sections 114*a*, 114*b* of the edge sections 110 are the portions of the seat cushion 100 on which a person sits. The upper central section 124 of the central section 120 is visible through the channel 130. As described above, the channel 130 extends between the edge sections 110 and above the upper central section 124 through the entirety of the seat cushion 100 from back to front or from front to back.

In its simplest form, the seat cushion 100 is used in a drum throne, stool, or other type chair that attaches to a generally round base. (See FIG. 11 below for an example of a drum throne 1100, FIG. 12 for an example of a stool 1200, and FIG. 13 for an example of chair 1300.) In other embodiments, the shape of the seat cushion 100 is modified for various uses. For example, in one embodiment the seat cushion 100 requires no base but rather is used as a portable cushion. In such an embodiment, the seat cushion has a solid base 200 and can be placed anywhere that the seat cushion 100 is needed such as, for example, an existing chair, an automobile seat, an airplane seat, a bus seat, bench seating, stadium seating, and the like. In other embodiments, the base 200 is adapted to better fit the particular seat on which the seat cushion 100 is to be used.

Figure 7:
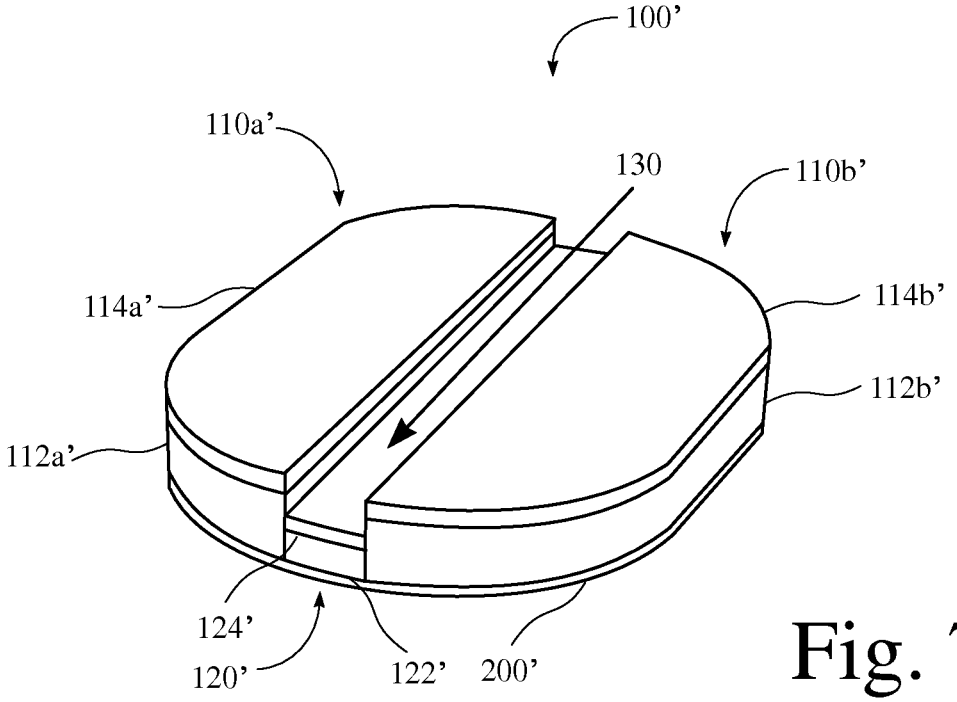
FIG. 7 is a perspective view of an elongated seat cushion.

FIG. 7 is a perspective view of an embodiment of an elongated seat cushion 100'. The elongated seat cushion 100' is such as would be suitable for an office chair, that is, the elongated seat cushion 100' is slightly elongated and typically slightly wider. The elongation provides a location for chair arms, for example. In some embodiments, chair arms are attached to a chair with a seat cushion 100 that is substantially round when viewed from the top.

In the illustrated embodiment, the edge sections 110*a*', 110*b*' are slightly elongated, that is the edge sections 110' are longer in one dimension, parallel with the channel 130', than the other. The edge sections 110*a*' 110*b*' include lower portions 112*a*', 112*b*' and upper portions 114*a*', 114*b*'. A central section 120' includes a lower central section 122' and an upper central section 124'. The elongated seat cushion 100' is affixed to an elongated base 200'. As previously, the channel 130 extends through the entirety of the seat cushion 100' from front to back, or from back to front, between the edge sections 110' and above the central section 120'.

Figure 8:
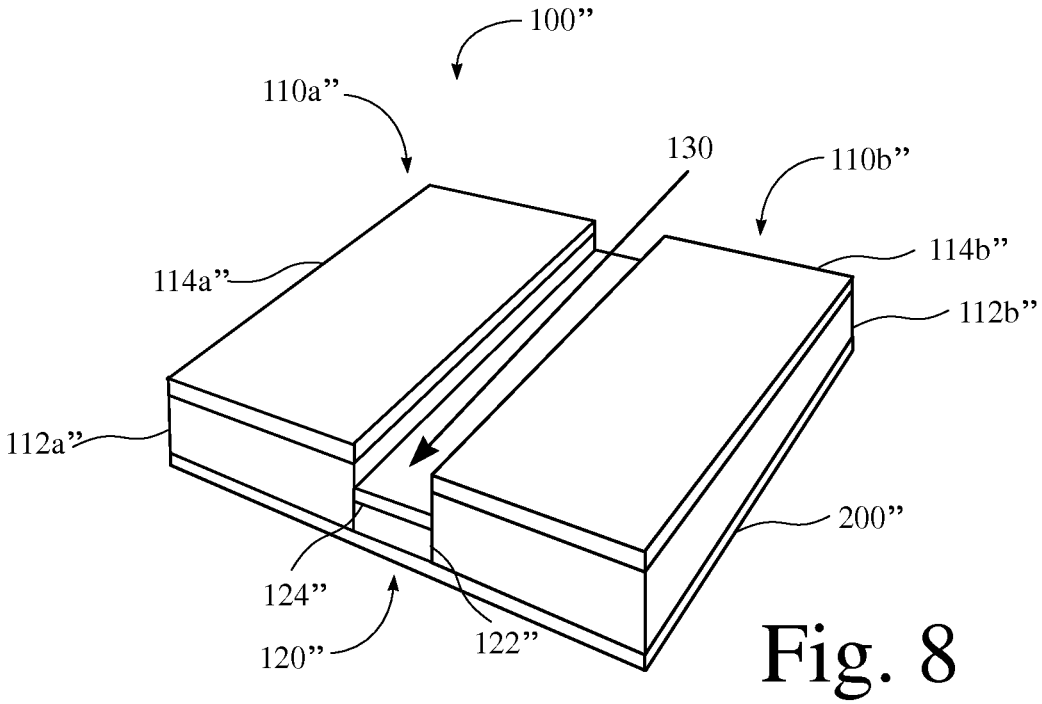
FIG. 8 is a perspective view of a rectangular seat cushion.

FIG. 8 is a perspective view of a rectangular seat cushion 100". The rectangular seat cushion 100" is such as would be suitable for rectangular stools or for bench type seating. In some embodiments, the rectangular seat cushion 100" is a square cushion that is readily portable for use on a bench as in a stadium or park, for example.

In the illustrated embodiment, the edge sections 110*a*', 110*b*' include lower portions 112*a*", 112*b*" and upper portions 114*a*", 114*b*". A central section 120" includes a lower central section 122" and an upper central section 124". The rectangular seat cushion 100" is affixed to a rectangular base 200". As previously, the channel 130 extends through the entirety of the seat cushion 100" from front to back, or from back to front, between the edge sections 110" and above the central section 120".

Figure 9:
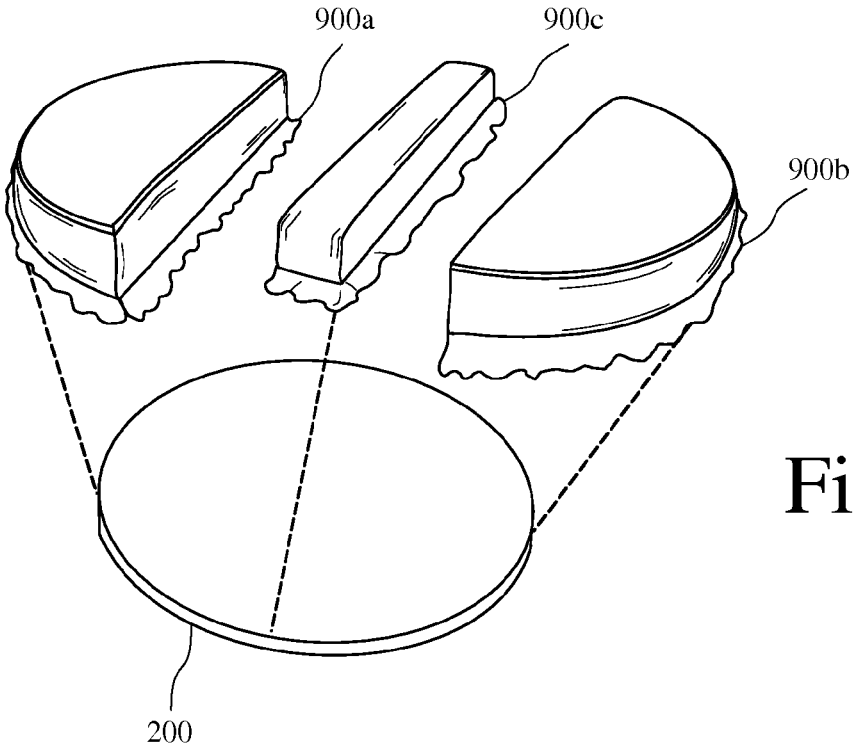
FIG. 9 is a partially exploded view of the seat cushion of FIG. 1 that illustrates an upholstery covering for each main section.

FIG. 9 is a partially exploded view of the seat cushion 100 that illustrates a covering 900 for each main section. In the illustrated embodiment, coverings 900*a*, 900*b* are wrapped around the edge sections 110. A covering 900*c* is wrapped around the central section 120. In the illustrated embodiment, the coverings 900 are not secured to the bottom of the respective section of the seat cushion 100. Rather, each section is affixed to the base 200 and the coverings 900 are secured to the underside of the base 200.

In one embodiment, the coverings are a durable vinyl. Such a covering provides for ease of maintenance and cleaning of the seat cushion 100. In other embodiments, the covering is leather, cloth, or any other material as is customarily provided as a covering for chairs and the like.

Figure 10:
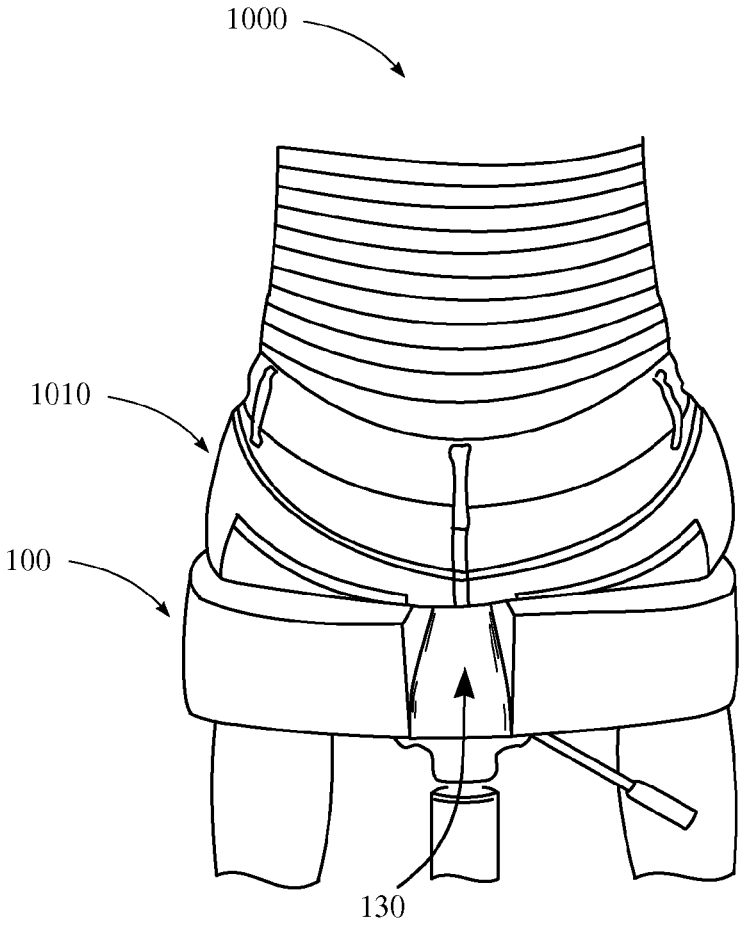
FIG. 10 is an illustration of a person seated on the seat cushion as viewed from the rear.

FIG. 10 is an illustration of a person 1000 seated on the seat cushion 100 as viewed from the rear. It should be noted that a portion of the posterior 1010 of the person 1000 remains above the channel 130. The seat cushion 100 does not collapse the channel 130. In this way, the seat cushion 100 provides for reduced pressure to the spine and other sensitive areas while the person 1000 is sitting. When the person 1000 is aligned over the channel 130, the channel 130 essentially provides for a floating spine, whether the person 1000 is seated at the forward, middle, or rear of the seat that contains the seat cushion 100.

The seat cushion 100 provides relief from back pain, coccyx fracture, coccyx pain, hemorrhoids, inflamed prostrate, and anal pain. The seat cushion 100 generally reduces fatigue that is often caused by sitting.

The seat cushion 100 relieves the pressure on the anal region and provides for a comfortable seating experience.

Figure 11:
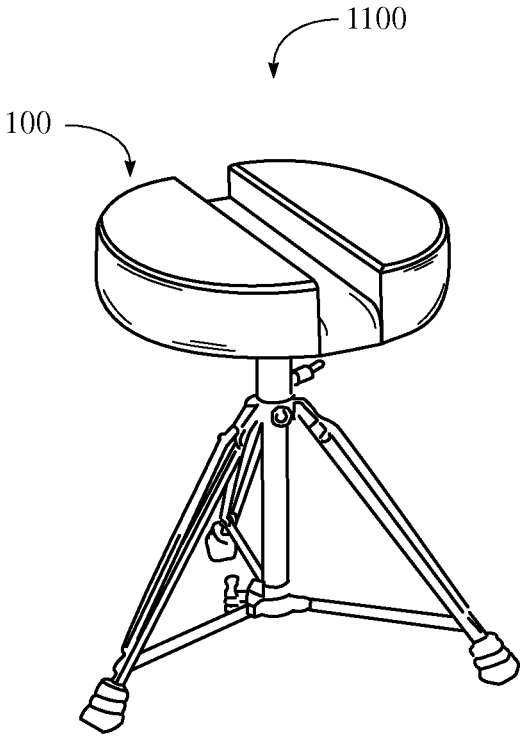
FIG. 11 is an exemplary embodiment of the seat cushion for use with a drum throne.

FIG. 11 is an illustration of an exemplary embodiment of the seat cushion 100 for use with a drum throne 1100. The drum throne 1100 includes a tripod to which the seat cushion 100 is attached. Those of skill in the art will readily appreciate that other type leg structures can be attached to the seat cushion without departing from the scope of the present invention. It will be readily appreciated by those of skill in the art that the drum throne 1100 could also include seat cushions 100 of varying styles and shapes without departing from the scope of the present invention.

Figure 12:
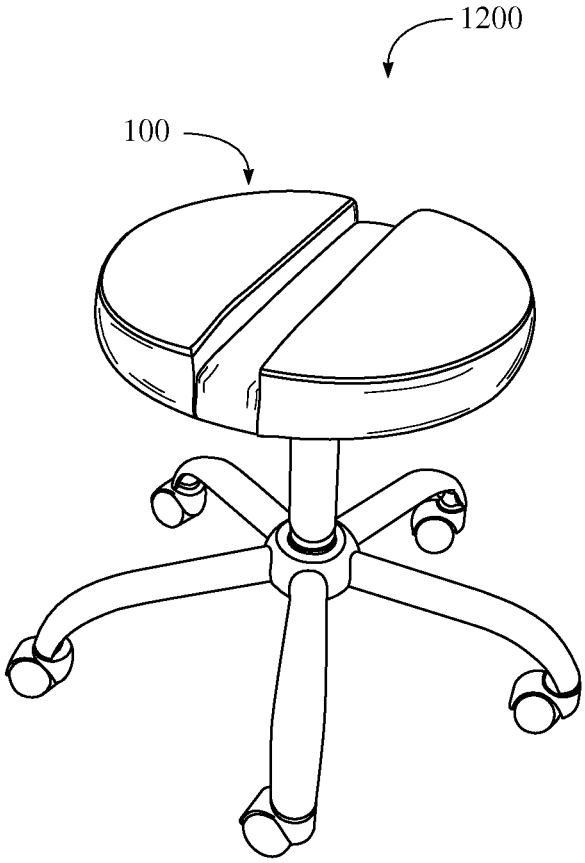
FIG. 12 is an exemplary embodiment of the c seat cushion ushion for use with a stool.

FIG. 12 is an illustration of an exemplary embodiment of the seat cushion 100 for use with a stool 1200. It will be readily appreciated by those of skill in the art that the stool 1200 could also include seat cushions 100 of varying styles and shapes without departing from the scope of the present invention.

Figure 13:
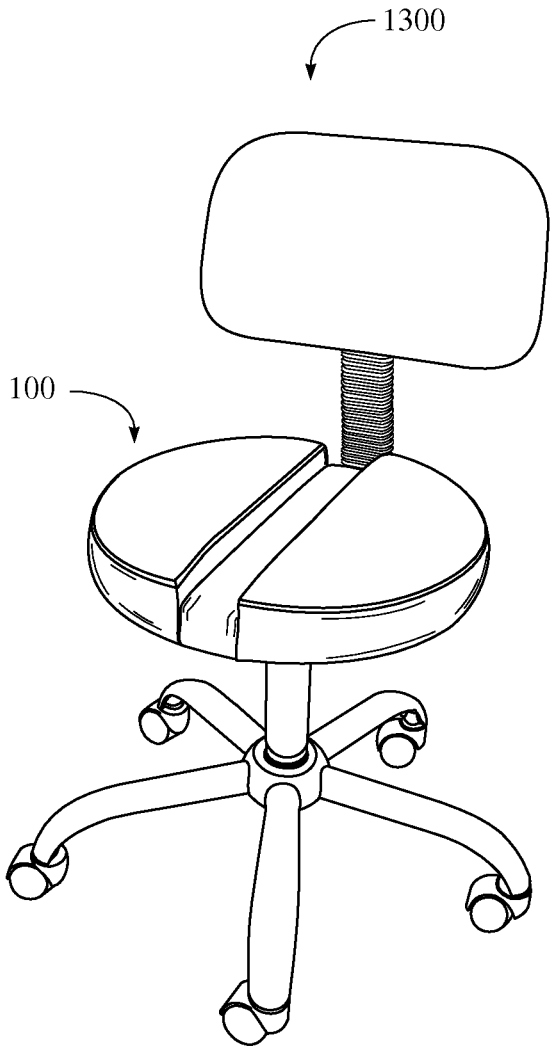
FIG. 13 is an exemplary embodiment of the seat cushion for use with a chair having a backrest.

FIG. 13 is an illustration of an exemplary embodiment of the seat cushion 100 for use with a chair 1300 having a backrest. As above, it will be readily appreciated by those of skill in the art that the chair 1300 could also include seat cushions 100 of varying styles and shapes without departing from the scope of the present invention. For example, the seat cushion 100 could be replaced by an elongated seat cushion 100' such as is shown in FIG. 7 to form a chair that is more akin to an office chair or such like. Additionally, arm rests can be added to the chair to form a more formal office chair. The functionality and use of the seat cushion 100, including the channel 130, is not affected by whether the seat cushion 100 is elongated, square, or otherwise shaped, and/or whether the chair includes arms or a backrest.

The seat cushion 100 includes various functions. The function of providing a floating spine, that is preventing the tailbone from resting on a solid surface of the seat cushion 100 is implemented, in one embodiment, by corresponding edge sections 110*a*, 110*b* adjacent on either side of a central section 120, wherein the central section has a lower height than the edge sections, so that a channel 130, or empty space, is formed above the central section 120 and between the edge sections 110*a*, 110*b*.

From the foregoing description, it will be recognized by those skilled in the art that a seat cushion 100 for reducing back pain has been provided. In particular, the seat cushion 100 provides a channel 130 separating two foam type cushion sections, the edge sections 110, and extending lengthwise from the front to the rear of the seat cushion 100 to remove pressure to the spine and to other sensitive areas while the person is sitting.

Sitting, especially prolonged sitting is generally accepted as a risk factor in developing low back pain. Several factors are considered to be important components of this association, including disc compression, lack of spinal motion and loading of the spine stabilizing muscles.

The seat cushion 100 disclosed herein provides for reducing pressure to the spine. The seat cushion 100 includes a channel 130 or trough, that is, an empty space, which runs lengthwise from the front to the rear of the seat cushion 100. Support is provided to the remainder of the posterior of a sitting person, while also allowing the coccyx (tailbone) to remain afloat above the surface of the channel 130.

The seat cushion 100 provides for reduced pressure to the spine and other sensitive areas while sitting. The channel 130 within the seat cushion 100 provides for a floating spine, whether the person is seated at the forward, middle, or rear of the seat or chair that contains the seat cushion 100. The seat cushion 100 provides relief from back pain, coccyx fracture, coccyx pain, hemorrhoids, inflamed prostrate, and anal pain. Also, the seat cushion 100 generally reduces fatigue that is often caused by sitting. Additionally, the seat cushion 100 relieves the pressure on the anal region and provides for a comfortable seating experience.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A seat cushion for reducing back pain via elevation of specific areas of a user's posterior and back, the seat cushion comprising:

two outer sections having a generally semicircular shape and a first height, each outer section including a lower layer of firm foam having a first thickness and an upper layer of soft foam having a second thickness, wherein the first thickness exceeds the second thickness;

an inner section having a generally rectangular shape with a length and a width and a second height, the second height less than the first height, the inner section extending lengthwise between the outer sections, wherein a channel is formed above the inner section and between the outer sections, the channel having a channel height and a channel width; and a cushion base corresponding to the two outer sections and the inner section, the cushion base providing support for the two outer sections and the inner section, whereby for the user sitting on the seat cushion, a specific area of the user's posterior and back aligned with the channel is elevated above the channel to relieve pressure on the specific area.

2. The seat cushion of claim 1 further including a leg portion attached to the base.

3. The seat cushion of claim 2, wherein the leg portion is a tripod.

4. The seat cushion of claim 2, wherein the leg portion is a base having casters and wheels.

5. The seat cushion of claim 1 wherein the ratio of the first thickness to the second thickness is 3:1.

6. The seat cushion of claim 1 wherein the ratio of the first height to the channel height is 2:1.

7. The seat cushion of claim 1 wherein the ratio of channel width to channel height is 5:3.

8. A seat cushion for reducing pain, the seat cushion comprising:

two outer sections having a generally semicircular shape and a first height, each outer section including a lower layer having a first thickness and an upper layer having a second thickness, wherein the first thickness exceeds the second thickness;

an inner section having a generally rectangular shape with a length and a width and a second height, the second height less than the first height, the inner section extending lengthwise between the outer sections, wherein a channel is formed above the inner section and between the outer sections, the channel having a channel height and a channel width; and a cushion base corresponding to the two outer sections and the inner section, the cushion base providing support for the two outer sections and the inner section, whereby for a user sitting on the seat cushion, a specific area of the user's posterior and back aligned with the channel is elevated above the channel to relieve pressure on the specific area.

9. The seat cushion of claim 8 wherein the lower layer is a firm foam.

10. The seat cushion of claim 8 wherein the upper layer is a soft foam.

11. The seat cushion of claim 8 further including a leg portion attached to the base.

12. The seat cushion of claim 11, wherein the leg portion is a tripod.

13. The seat cushion of claim 11, wherein the leg portion is a base having casters and wheels.

14. The seat cushion of claim 1 wherein the ratio of the first thickness to the second thickness is 3:1.

15. The seat cushion of claim 1 wherein the ratio of the first height to the channel height is 2:1.

16. The seat cushion of claim 1 wherein the ratio of channel width to channel height is 5:3.

* * * * *